United States Patent [19]

Woodward

[11] B 4,005,826

[45] Feb. 1, 1977

[54] INJECTORS FOR THE FUEL INJECTION SYSTEMS OF INTERNAL COMBUSTION ENGINES

[75] Inventor: Henry Edwin Woodward, Bourne End, England

[73] Assignee: National Research Development Corporation, London, England

[22] Filed: Jan. 16, 1975

[21] Appl. No.: 541,501

[44] Published under the second Trial Voluntary Protest Program on April 13, 1976 as document No. B 541,501.

Related U.S. Application Data

[63] Continuation of Ser. No. 368,991, June 11, 1973, abandoned.

[30] Foreign Application Priority Data

June 12, 1972 United Kingdom ..... 27449/72

[52] U.S. Cl. ..... 239/533.8

[51] Int. Cl.[2] ..... B05B 1/30

[58] Field of Search ..... 239/533

[56] References Cited

UNITED STATES PATENTS

| | | | |
|---|---|---|---|
| 3,521,819 | 7/1970 | Johnston | 239/533 |
| 3,610,529 | 10/1971 | Huber | 239/533 |
| 3,640,466 | 2/1972 | Steiger | 239/533 |
| 3,669,354 | 6/1972 | Helyer | 239/533 |
| 3,680,782 | 8/1972 | Monpetit | 239/533 |

FOREIGN PATENTS OR APPLICATIONS

| | | |
|---|---|---|
| 640,653 | 7/1950 | United Kingdom |

*Primary Examiner*—Lloyd L. King
*Attorney, Agent, or Firm*—Marn & Jangarathis

[57] ABSTRACT

There is disclosed an injector for a fuel injection system for an internal combustion engine and comprising a nozzle body formed with a compartment within which there is positioned a nozzle needle biased towards a closed position by a spring. A first chamber is formed between the valve seat and one end of a guide for the nozzle needle and a second chamber is formed at the other end of said guide, the arrangements being such that fuel under pressure is supplied to both said chambers simultaneously and that the nozzle needle is seated until the pressure in said second chamber is relieved by opening of a trigger valve under increasing fuel supply pressure to cause the nozzle needle to move to open the injection valve for the supply of fuel to the engine.

9 Claims, 3 Drawing Figures

INJECTORS FOR THE FUEL INJECTION SYSTEMS OF INTERNAL COMBUSTION ENGINES

Figure 1:
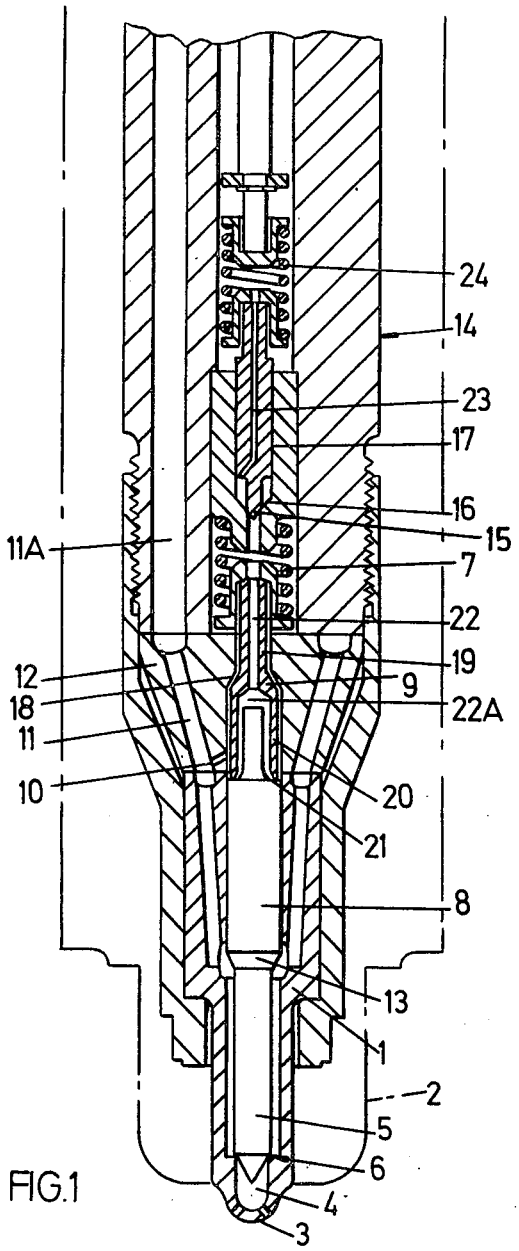

This is a continuation of application Ser. No. 368,991, filed June 11, 1973, now abandoned.

The invention relates to injectors for the fuel injection systems of internal combustion engines.

The object of the invention is to provide an improved injector which will be of smaller size for a specified maximum injection rate than the current conventional injectors and will include a nozzle needle valve of smaller size than normal for the said specified rate and thus have a lower mass.

The size of an inwardly opening nozzle needle valve of a conventional injector is governed by the provision of the required flow area with a suitably small needle valve lift. This determines the sac diameter, and to create satisfactory opening conditions the needle valve seat must be of substantially larger diameter. The tip of the needle valve and its seat in the nozzle body must be made to closely controlled limits to provide the known requirement for a differential angle between them. In order that the nozzle valve is operated mainly by fuel pressure rather than cylinder gas pressure the annular area between the said seat diameter and the diameter of the needle valve guide must be much larger than the internal area of the said seat. Thus the diameter of the nozzle valve guide must be much larger than the diameter of the sac and this controls the size of the nozzle body and the external size of the injector.

A conventional nozzle opens when the fuel pressure on the said annular area plus the cylinder gas pressure on the needle valve exceeds the closing force exerted by the needle valve spring. Thus an increase of cylinder gas pressure due to combustion allows the needle valve to re-open for secondary injection at a lower fuel pressure than that required for the initial opening of the needle valve, and it is a further object of the invention to overcome this disadvantage.

The invention consists in an injector for a fuel injection system of an internal combustion engine having a nozzle needle which is biased towards its closed position by a spring means characterized by the provision of a first space positioned between the valve seating and one end of the valve guide, and a second space at the other end of said valve guide, arrangements being made for the supply of fuel under pressure simultaneously to both said spaces and further characterized in that the opening of the valve is controlled by reducing the pressure in said second space relative to the pressure in said first space.

The invention further consists in an injector as set forth in the preceding paragraph in which the control of the reduction of the pressure of the fuel in said second space to open the valve is by means of a trigger valve.

The invention still further consists in an injector as set forth in the preceding paragraph in which the trigger valve is adapted to provide a predetermined reduced pressure of fuel relative to the supply pressure after the said trigger valve opens.

The invention still further consists in an injector as set forth above in which the supply of fuel to said second space is by way of a passage of restricted cross-sectional area, so that when the pressure in said chamber is reduced the supply pressure is not adversely affected.

Figure 2:
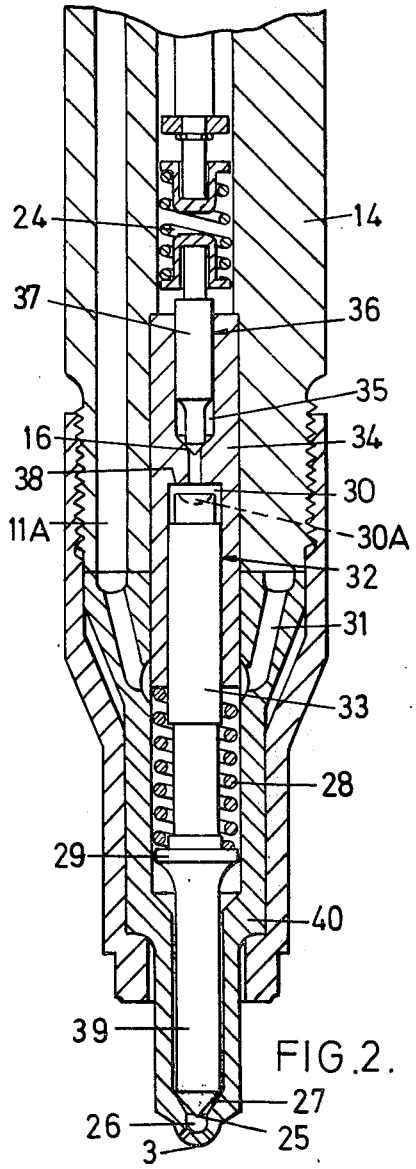
Figure 3:
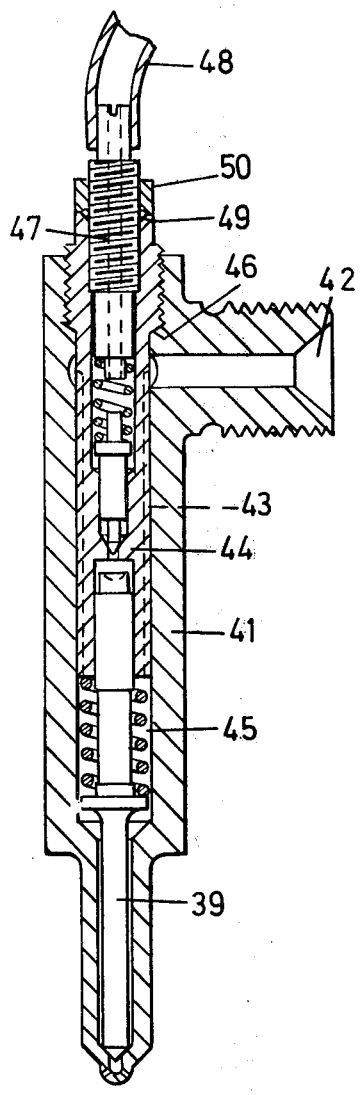

The accompanying drawings show, by way of example only, three embodiments of the invention in which, FIG. 1 is a longitudinal section through the nozzle end of a first embodiment of an injector, FIG. 2 is a longitudinal section through the nozzle end of a second embodiment of an injector, while FIG. 3 is a longitudinal section through a third embodiment of an injector.

The injector constructed in accordance with the invention incorporates a nozzle which does not require a small differential angle and therefore the sac diameter and the internal diameter of the needle valve seat can be identical. The construction of the nozzle is such that it is insensitive to cylinder gas pressure so that the annular area between the needle valve seat diameter and the diameter of the needle valve guide can be small. The needle valve guide diameter need be little greater than the sac diameter and therefore the size of the nozzle and the injector of which it forms part can be greatly reduced.

The advantages of the injector in accordance with the present invention also include:

1. The nozzle needle valve is sensitive only to fuel line pressure so the increase of gas pressure caused by combustion does not tend to produce secondary injection.
2. High opening and closing pressures are possible with a relatively low rated needle valve spring.
3. These high operating pressures are achieved by a design which allows only low impacting forces at both the needle valve seat and its lift stop, thereby extending service life.
4. Elimination of dependence on nozzle action on the differential angle seat increases the period between overhaul and facilitates manufacture. It also allows a greater flow area through the seat for a given lift of the needle valve.
5. The method of loading the nozzle needle dampens secondary pressure oscillations and so reduces the susceptibility to secondary injection.
6. The reduced end area of the nozzle subject to cylinder gas temperature reduces the need for cooling the nozzle.
7. The reduced space occupied by the injector allows more space in the cylinder head for other features.

It is convenient to refer to conventional injectors by their well known designations, i.e. S size nozzle, T size nozzle, U size nozzle and V size nozzle, which typically have 24, 32, 45 and 65 mm. stem diameters and 17, 22, 30 and 42 mm. maximum nozzle body diameters respectively.

In FIG. 1 the nozzle 1 has the dimensions of a S size nozzle, which can be used in place of a U size nozzle, the external size of which is indicated by the broken line 2. The outer contour of the tip 3 of the construction in accordance with the invention is the same as for a U size nozzle, and sac 4 is also the same. As a differential angle is not required, the seat 6 for the needle valve 5 need not be a line contact and the load can be spread over a finite radial width.

The needle valve 5 is loaded to the closed position by a needle valve spring 7 and by fuel line pressure acting on the whole of the area of the needle valve guide 8. The spring housing and the space occupied by the needle valve push rod 9 are pressurised by being connected via the small restricting passage 10 to the fuel supply passage 11 in the transfer block 12. The force of the needle valve spring 7 need be no more than that required to hold the needle valve closed against the force of cylinder gas pressure acting on the area of the needle valve inside the sac 4 when there is no fuel pressure at the nozzle.

The needle valve is opened by releasing the loading at the spring end, instead of the normal procedure of increasing the lifting force at the sac end, so the annular area 13 between the seat 6 and guide 8 need not be large and the standard guide, as for an S size nozzle, can be used. This enables all of the exterior dimensions of the nozzle body 1, apart from the tip contour 3, to be the same as for a standard S size nozzle. The clearance between the nozzle body 1 and the needle valve guide 8 does not require to be made very small, as in a conventional nozzle in order to control leakage, because in the present design the same fuel pressure is fed to both ends of the needle valve. This feature reduces the likelihood of the needle valve sticking in service. The injector stem 14 is the intermediate T size diameter and accommodates the needle valve spring 7 in a low position and a feed passage 11A of a diameter equal to that of a U size injector.

At the start of pumping, fuel pressure acts on the whole of the spring end of the needle valve and on only the annular area 13 at the sac end. Pressure rises until that at the top end is relieved by the lifting of the trigger valve 15 located immediately above the needle valve spring 7. Pressure in the supply passage 11 does not drop substantially, because of the small restricting passage 10, so upward forces on the needle are maintained and it opens. Supply pressure then acting on the whole lower end of the needle valve increases the lifting force.

The seat 16 of the trigger valve is smaller in area than its guide 17. Once this valve opens it will stay open until the pressure in the housing for the nozzle spring 7 falls to a much lower level than the opening pressure.

A relief passage 23 through the trigger valve may be required dependent on the residual pressure in the fuel line. If the relief is used, the trigger valve will seat after the needle valve reaches full lift trapping a limited pressure in the needle spring chamber. If the relief is not used the trigger valve will maintain the same limited pressure in the spring chamber during injection. It will seat after injection by discharging fuel past the needle valve spring and push rod, through the small restricting passage 10 back into the supply passage 11.

In order to prevent loss of fuel past the trigger valve throughout the whole injection period, the push rod 9 makes a seal on a conical seat 18 when the needle valve is lifted. The narrow section 19 of the push rod 9 is given limited clearance with the passage in the transfer block 12 and the large end 20 of the said push rod in moving towards the seat 18 acts as a damper. This limits the impact velocity when the needle valve reaches its upper limit of travel, so preventing impact damage at the conical seat 18.

When the needle valve push rod rests against the conical seat 18 the area within the seat is subject to the relatively low pressure maintained by the trigger valve 15 after opening. Thus fuel pressure acting on the whole of the sac end of the needle valve holds it open. The push rod 9 seats on the needle valve at the face 21 and the passage 22 vents the space 22A, between the needle valve and push rod, to the low pressure space around the needle valve spring 7. This ensures that the loading due to fuel pressure at each end of the needle valve cannot be equal.

The needle valve spring 7 is made strong enough to prevent lifting of the needle by the force of cylinder gas pressure acting on that part of the needle tip within the sac 4, when there is no fuel pressure at the nozzle. This needle spring strength is the major factor in determining the minimum fuel line pressure at which the nozzle will open. Above this limit the opening is controlled solely by the setting of the trigger valve spring 24 which is adjustable by any convenient method. Thus in the operating range the nozzle is sensitive only to fuel line pressure and is insensitive to cylinder gas pressure. Because of the small area of the seat 16 of the trigger valve, high opening pressure can be used with moderate strength of the spring 24. The relatively low loading of the nozzle needle spring 7, and the relatively small mass of the needle 8, 5, compared to the corresponding component of conventional nozzles of the same duty, reduces the impacting forces at the seat 6 when the nozzle closes.

Secondary injections are subdued by three features of the nozzle, two of which have previously been mentioned, i.e. the suitability for high opening pressure and the insensitivity to rising cylinder gas pressure.

The third feature is the damping effect of the capacity of the nozzle spring chamber on pressure oscillations. During the period of return flow in passage 11A, after the pump spills, fuel will flow from the chamber of the spring 7 to the supply passage 11A via the small restricting passage 10, so tending to maintain residual pressure at the injector end of the fuel line. This reduces magnitude of a secondary flow towards the nozzle. The returning positive pressure wave will be softened by some fuel flowing into the chamber of the spring 7.

The construction shown in FIG. 2 illustrates a construction avoiding a small differential angle between the nozzle body seat and the needle tip and, enables a large differential angle to be used. This increases the gap 25 at entry to the sac 26, so that adequate flow area is obtained with a reduced sac diameter. The quantity of fuel remaining downstream of the seat 27 after injection is thus reduced.

The needle valve spring 28 operates directly on a flange 29 of the needle valve 39. The volume of fuel in the space 30 at the trigger valve end of the needle valve is connected to the supply passage 31 by the clearance 32 between the guide section 33 of the needle valve and the trigger valve housing 34. Retention of pressure in the space 35 between injections is prevented by providing suitable clearance 36 between the trigger valve 37 and the trigger valve housing 34. When the needle valve is fully lifted it abuts against the stop 38 which prevents injection pressure reaching the space 30A. The transfer block 12 and nozzle 1 of FIG. 1 are combined in the nozzle 40 of FIG. 2. The push rod 9 of FIG. 1 is eliminated in FIG. 2.

The embodiment shown in FIG. 3 is particularly suitable for small engines. Its operation is identical to that of FIG. 2 but the one piece body 41 provides mechanical simplification. Fuel enters the injector at the hydraulic coupling 42 and flows along grooves 43 in the outer surface of the trigger valve housing 44 to the space 45 around the needle valve 39. The operating sequence is then as previously described. The trigger valve housing is screwed into the body and the seat 46 seals against injection pressure. The trigger valve setting screw 47 is hollow so that leak-off fuel can be carried away by the attached pipe 48. A resilient seal 49 under lock nut 50 prevents leakage along the thread of the setting screw.

It is to be understood that the above description is by way of example only and that details for carrying the invention into effect may be varied without departing from the scope of the invention claimed.

I claim:

1. An injector including a fuel supply passage for a fuel injection system of an internal combustion engine which comprises:

a. a nozzle body formed with a compartment and including a valve seat;

b. a nozzle needle positioned within said compartment of said nozzle body and cooperating with said valve seat to form an injection valve;

c. guide means for guiding said nozzle needle within said nozzle body, one end of said guide means forming a first chamber including part at least of said compartment, the other end of said guide means forming a second chamber within said injector, said first and second chambers being in fluid communication with said fuel supply passage, the cross-sectional area bounded by the other edge of contact between said nozzle needle and said valve seat being smaller than the cross-sectional area of said guide means;

d. spring means for biasing said nozzle needle against said valve seat; and e. trigger valve means for opening said second chamber at a first predetermined pressure within said second chamber and for closing said second chamber at a second lower predetermined pressure within said second chamber whereby (i) an increase in fuel supply pressure causes said trigger valve means to open when the pressure in said second chamber reaches a value substantially equal to or greater than said first predetermined pressure, thereby relieving the pressure in said second chamber so that the resultant force on said nozzle needle causes the nozzle needle to lift from said valve seat for the injection of fuel and (ii) said trigger valve means recloses said second chamber when the pressure in said second chamber reduces to a value substantially equal to or lower than said second predetermined pressure, said nozzle needle being returned into contact with said valve seat under the influence of said spring means.

2. The injector as defined in claim 1 wherein said second chamber is in fluid communication with said fuel supply passage via a restriction whereby a reduction in pressure in said second chamber does not adversely affect the fuel supply pressure.

3. The injector as defined in claim 1 wherein said guide means forms part of said nozzle body and said trigger valve means forms part of a separate body fixed relatively to said nozzle body.

4. The injector as defined in claim 1 wherein said guide means and said trigger valve means forms part of a common body fixed relatively to said nozzle body.

5. The injector as defined in claim 1 wherein a push rod is provided between said spring means and said nozzle needle, said push rod forming a valve which closes to prevent fluid communication between said trigger valve and said fuel supply passage after fuel injection has commenced.

6. The injector as defined in claim 1 wherein said spring means acts directly on said nozzle needle and wherein the other end of said nozzle needle forms a valve which closes to prevent fluid communication between said trigger valve and said fuel supply passage after fuel injection has commenced.

7. The injector as defined in claim 5 wherein said spring means is disposed in said second chamber.

8. The injector as defined in claim 6 wherein said spring means is disposed within said first chamber.

9. The injector as defined in claim 1 wherein said second chamber is in fluid communication with said fuel supply passage via said guide means for said nozzle needle.

* * * * *